US007472728B1

(12) United States Patent
Geffen

(10) Patent No.: US 7,472,728 B1
(45) Date of Patent: Jan. 6, 2009

(54) ELECTRICALLY POWERED RAPID SHARPENING COSMETIC PENCIL SHARPENER

(75) Inventor: Judith Geffen, West Toluca Lake, CA (US)

(73) Assignee: Beauty Points, Inc., West Toluca Lake, CA (US)

( * ) Notice: Subject to any disclaimer, the term of this patent is extended or adjusted under 35 U.S.C. 154(b) by 65 days.

(21) Appl. No.: 11/529,411

(22) Filed: Sep. 27, 2006

Related U.S. Application Data

(63) Continuation-in-part of application No. 11/149,468, filed on Jun. 8, 2005, now abandoned.

(51) Int. Cl.
*B43L 23/02* (2006.01)

(52) U.S. Cl. ..... 144/28.5; 144/28.72

(58) Field of Classification Search ..... 144/28.1, 144/28.4, 28.5, 28.72, 28.9; 30/451–460
See application file for complete search history.

(56) References Cited

U.S. PATENT DOCUMENTS 3,556,182 A * 1/1971 Tanigami ..... 144/28.5
D251,977 S 5/1979 Leuenberger
4,248,283 A 2/1981 Kaye
4,281,698 A 8/1981 Mobius
D262,295 S 12/1981 Kaye
4,402,354 A 9/1983 Halpern
4,966,208 A * 10/1990 Uang ..... 144/28.72
5,379,817 A 1/1995 O'Neil
D378,835 S 4/1997 Guerrero
5,875,555 A 3/1999 Andrisin
5,894,669 A 4/1999 Luttgens
6,065,514 A 5/2000 New
D431,263 S 9/2000 Greenhouse
6,470,929 B2 * 10/2002 Fregeolle ..... 144/28.72
6,530,153 B1 3/2003 Kleban
2004/0016476 A1 * 1/2004 Lamers et al. ..... 144/28.6
2004/0261275 A1 12/2004 Fregeolle

* cited by examiner

*Primary Examiner*—Shelley Self
(74) *Attorney, Agent, or Firm*—Thomas I. Rozsa

(57) ABSTRACT

The present invention is a novel electrically powered cosmetic pencil sharpener which firmly sits on a flat surface to avoid shaking during the sharpening process and firmly grips the cosmetic pencil tip to enable the apparatus to rapidly sharpen the paraffin wax tip within three (3) seconds so that the tip will not shatter or crack. The apparatus rapidly sharpens the cosmetic pencil so that its applicator end is formed at a thirty (30) degree angle with a flat tip so as to provide an ideal applicator end. The apparatus includes an indicator light that tells the individual that the sharpening process is complete.

3 Claims, 6 Drawing Sheets

ELECTRICALLY POWERED RAPID SHARPENING COSMETIC PENCIL SHARPENER

This application is a continuation-in-part of application Ser. No. 11/149,468 filed on Jun. 8, 2005 now Abandoned.

BACKGROUND OF THE INVENTION

1. Field of the Invention

The present invention relates to electrically powered apparatus which are used to sharpen a cosmetic pencil which is comprised of two separate mediums, a handle portion which is usually made of wood but can be made of other material such as plastic or resin, and a cosmetic applicator portion which is usually made of paraffin wax.

2. Description of the Prior Art

In general, the concept of sharpening a cosmetic pencil is known in the prior art. The following fourteen (14) patents are relevant to the field of the present invention.

1. U.S. Pat. No. Des. 251,977 issued to Leuenberger on May 29, 1979 for "Dual Cosmetic Pencil Sharpener" (hereafter the "Leuenberger Patent");

2. U.S. Pat. No. Des. 262,295 issued to Kaye on Dec. 15, 1981 for "Cosmetic Pencil Sharpener" (hereafter the "'295 Kaye Patent")

3. U.S. Pat. No. 4,248,283 issued to Kaye on Feb. 3, 1981 for "Cosmetic Pencil Sharpener" (hereafter the "'283 Kaye Patent");

4. U.S. Pat. No. 4,281,698 issued to Mobius on Aug. 4, 1981 for "Pencil Sharpener" (hereafter the "Mobius Patent");

5. U.S. Pat. No. 4,402,354 issued to Halpern on Sep. 6, 1983 for "Sharpener For Cosmetic Pencils" (hereafter the "Halpern Patent");

6. U.S. Pat. No. 5,379,819 issued to Uang on Oct. 30, 1990 for "Pencil Sharpener" (hereafter the "Uang Patent");

7. U.S. Pat. No. 5,379,817 issued to O'Neil on Jan. 10, 1995 for "Sharpener For A Soft Element Pencil" (hereafter the "O'Neil Patent");

8. U.S. Pat. No. Des. 378,835 issued to Guerrero on Apr. 15, 1997 for "Cosmetic Pencil Sharpener" (hereafter the "Guerrero Patent");

9. U.S. Pat. No. 5,875,555 issued to Andrisin on Mar. 2, 1999 for "Crayon Sharpener Assembly" (hereafter the "Andrisin Patent");

10. U.S. Pat. No. 5,894,669 issued to Luttgens on Apr. 20, 1999 for "Sharpener For Soft Core Pencils" (hereafter the "Luttgens Patent");

11. U.S. Pat. No. 6,065,514 issued to New on May 23, 2000 for "Compact Handheld Battery Operated Cosmetic Pencil Sharpener" (hereafter the "New Patent");

12. U.S. Pat. No. Des. 431,263 issued to Greenhouse on Sep. 26, 2000 for "Cosmetic Pencil Sharpener" (hereafter the "Greenhouse Patent");

13. U.S. Pat. No. 6,530,153 B1 issued to Kleban on Mar. 11, 2003 for "Cosmetic Pencil Sharpener" (hereafter the "Kleban Patent");

14. U.S. Patent Application Publication No. US2004/0261275 to Fregeolle on Dec. 30, 2004 for "Sharpener For Creating A Frusto-Conical Tip" (hereafter the "Fregeolle Patent").

The Leuenberger Patent is a design patent which discloses a mechanical handheld cosmetic pencil sharpener having two barrels to receive and mechanically sharpen a cosmetic pencil.

The '295 Kaye Patent is a design patent which discloses a mechanical handheld pencil sharpener which as disclosed in FIG. 8, has the ability to sharpen two different sized cosmetic pencils.

The '283 Kaye Patent is a utility patent which discloses a mechanical handheld pencil sharpener which has the ability to sharpen two different sized cosmetic pencils.

The Mobius Patent is a utility patent which discloses a mechanical pencil sharpener which has two different sized chambers to sharpen two different sized cosmetic pencils.

The Halpern Patent is a utility patent which discloses a mechanical pencil sharpener which can sharpen two different sized cosmetic pencils.

The Uang Patent is a utility patent which discloses an electric pencil sharpener which sharpens the pencils by means of a pair of oppositely rotating rollers.

The O'Neill Patent is a utility patent which discloses a sharpener for a soft element pencil which achieves the sharpening by means of a rotating sharpening blade which cuts a point onto the end of the pencil being sharpened.

The Guerrero Patent is a design patent which discloses a cosmetic pencil sharpener in the shape of a pyramid.

The Andrisin Patent is a utility patent which discloses a mechanical crayon sharpener having a pair of convergent sharpening blades.

The Luttgens Patent is a utility patent which discloses a mechanical device having a shaving rib which causes the tip of a pencil to be formed into the desired shape.

The Fregeolle Published Patent Application discloses a writing instrument sharpener which has one blade for cutting a tip and a second transverse cutting blade to form a frusto-conical tip.

The New Patent is a utility patent which discloses a handheld electrically powered cosmetic pencil sharpener which has a cutting blade having two sections to cut a pointed tip into a cosmetic pencil. By virtue of the fact that it has only one battery and is handheld, the cutting is extremely slow and the device can move while a person is holding it so that the brittle tip of a cosmetic pencil will more than likely shatter during the sharpening process.

The Greenhouse Patent is a design patent which discloses a design for the shape of a mechanical cosmetic pencil sharpener.

The Kleban Patent is a utility patent which discloses a mechanical cosmetic pencil sharpener which has a multiplicity of different sized openings to receive different sized cosmetic pencils.

None of the prior art discloses a rapid sharpening electrically powered cosmetic pencil sharpener which can quickly and efficiently sharpen a cosmetic pencil to a proper blunt point and sharpens it in a manner that will prevent the brittle paraffin wax material from shattering or cracking.

SUMMARY OF THE INVENTION

The present invention is a novel electrically powered cosmetic pencil sharpener which firmly sits on a flat surface to avoid shaking during the sharpening process and firmly grips the cosmetic pencil tip to enable the apparatus to rapidly sharpen the paraffin wax tip within three (3) seconds so that the tip will not shatter or crack. The apparatus rapidly sharpens the cosmetic pencil so that its applicator end is formed at a thirty (30) degree angle with a flat tip so as to provide an ideal applicator end. The apparatus includes an indicator light tells the individual that the sharpening process is complete.

It has been discovered, according to the present invention, that if a cosmetic pencil is firmly gripped during the sharpening process and is rapidly sharpened within three (3) seconds, the firm grip and rapid sharpening will prevent the fragile paraffin wax tip of the cosmetic pencil from shattering or cracking.

It has further been discovered, according to the present invention, that if the sharpening device has means to advise the user that the desired sharpening of the tip has been achieved, the over sharpening and breaking or cracking of the tip is eliminated.

It has additionally been discovered, according to the present invention, that if the device includes a multiplicity of different sized openings which can be rotatably aligned with the sharpening blade, then different sized cosmetic pencils can be sharpened by the same device.

It has also been discovered, according to the present invention, that if an indicator light is illuminated when the sharpening has been completed, the user will known to remove the cosmetic pencil from the sharpener.

It has further been discovered, according to the present invention, that if a safety switch is in contact with a shaving removal door so that the motor will automatically stop the cutting blade from rotating when the door is opened, then a consumer will not accidentally injure herself when the door is opened and the consumer reaches her hand into the device to remove shavings.

It is therefore an object of the present invention to provide an apparatus which will remain steady and firmly grip the cosmetic pencil during the sharpening process to prevent the paraffin wax portion of the cosmetic pencil from cracking or breaking while it is being sharpened.

It is another object of the present invention to provide an apparatus which can sharpen the cosmetic pencil to a thirty degree angle with a flat tip within three seconds so that the fragile paraffin wax portion of the cosmetic pencil will not crack or break.

It is a further object of the present invention to provide an apparatus which will advise the user when the desired amount of sharpening has been achieved and to provide a visual signal that the sharpening process has been completed.

It is another object of the present invention to provide safety features to prevent any accidents during the sharpening process.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
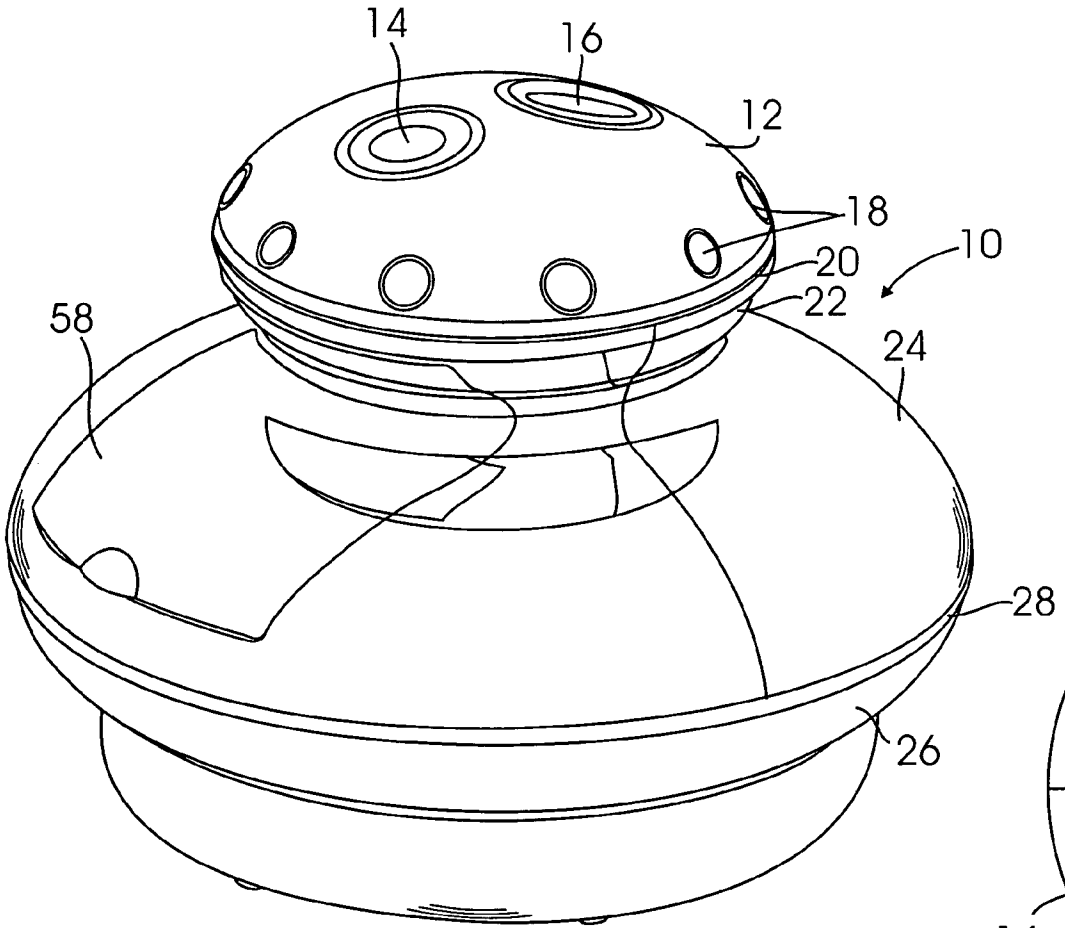
FIG. 1 is a perspective view of the present invention cosmetic pencil sharpener.
Figure 2:
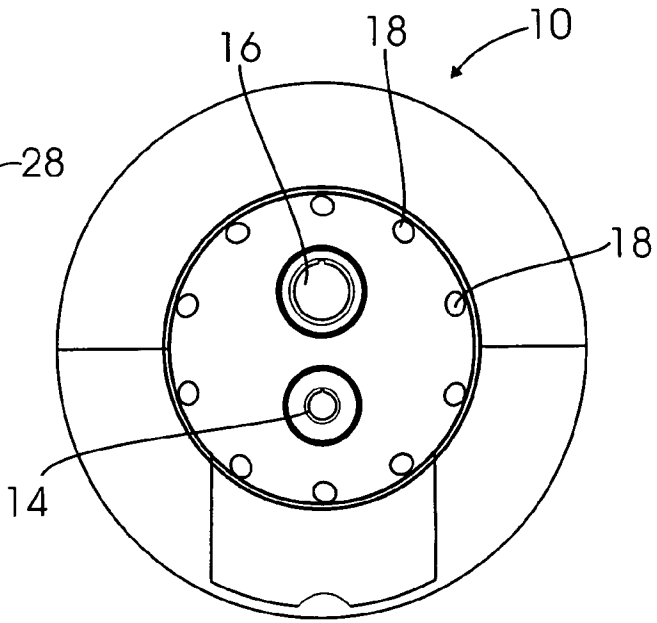
FIG. 2 is a top plan view of the present invention cosmetic pencil sharpener illustrated in FIG. 1.
Figure 3:
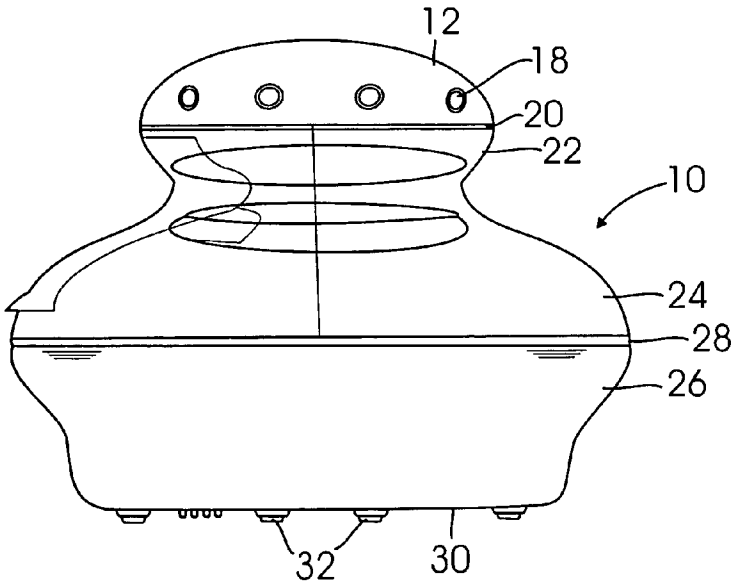
FIG. 3 is a side elevational view of the present invention cosmetic pencil sharpener illustrated in FIG. 1.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 6, there is illustrated the present invention cosmetic pencil sharpener 10. The exterior of the cosmetic pencil sharpener 10 is comprised of an arcuate partially hemispherical top surface 12 having a pair of oppositely disposed openings 14 and 16 of different diameters to receive cosmetic pencils of two different diameters. The top surface 12 also has a multiplicity of decorative detents 18 adjacent its outermost circumference. Immediately below the top surface is a circumferential see-through window 20 which transmits light. The structure then extends into a lower sectional wall 22 which extends into an upper casing wall 24 which is connected to a lower casing wall 26 with an interconnecting seam 28 between the upper and lower casing wall. The lower casing wall extends into a bottom wall 30 to which is attached a multiplicity of feet 32 on which the cosmetic pencil sharpener rests.

Figure 5:
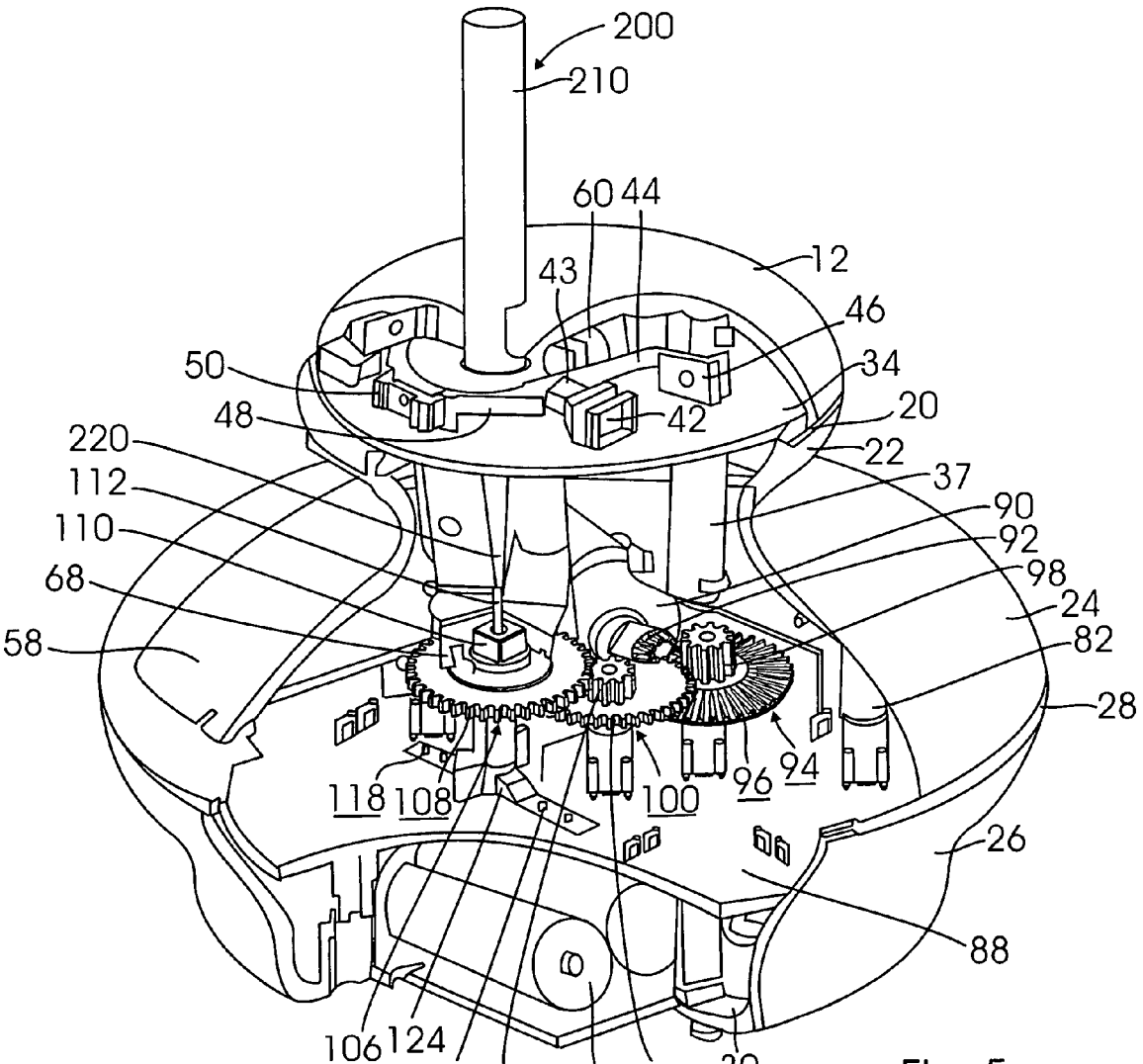
FIG. 5 is a cutaway perspective view of the present invention cosmetic pencil sharpener illustrated in FIG. 1.
Figure 6A:
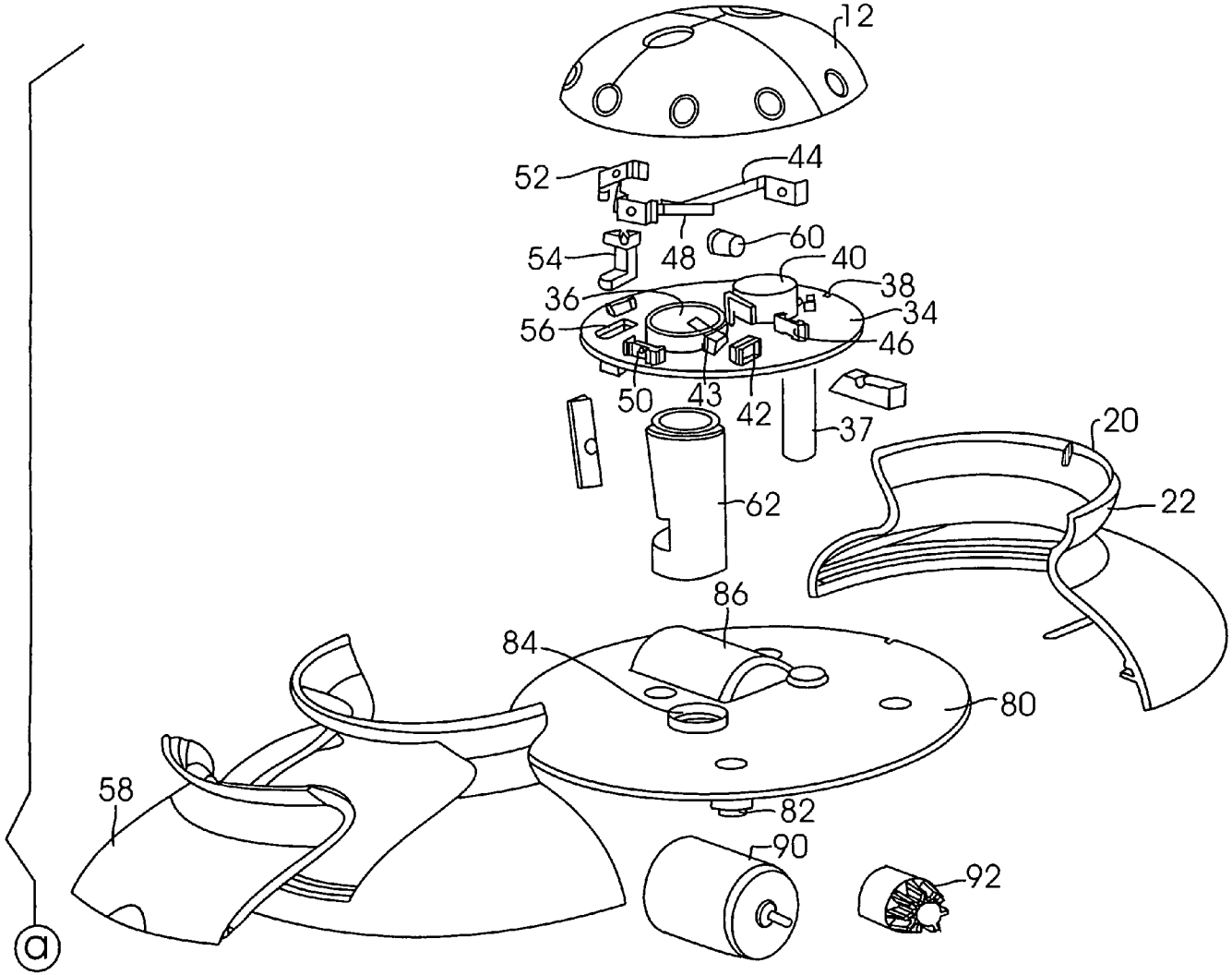
FIG. 6*a* is an exploded view of the top half of the present invention cosmetic pencil sharpener.
Figure 6B:
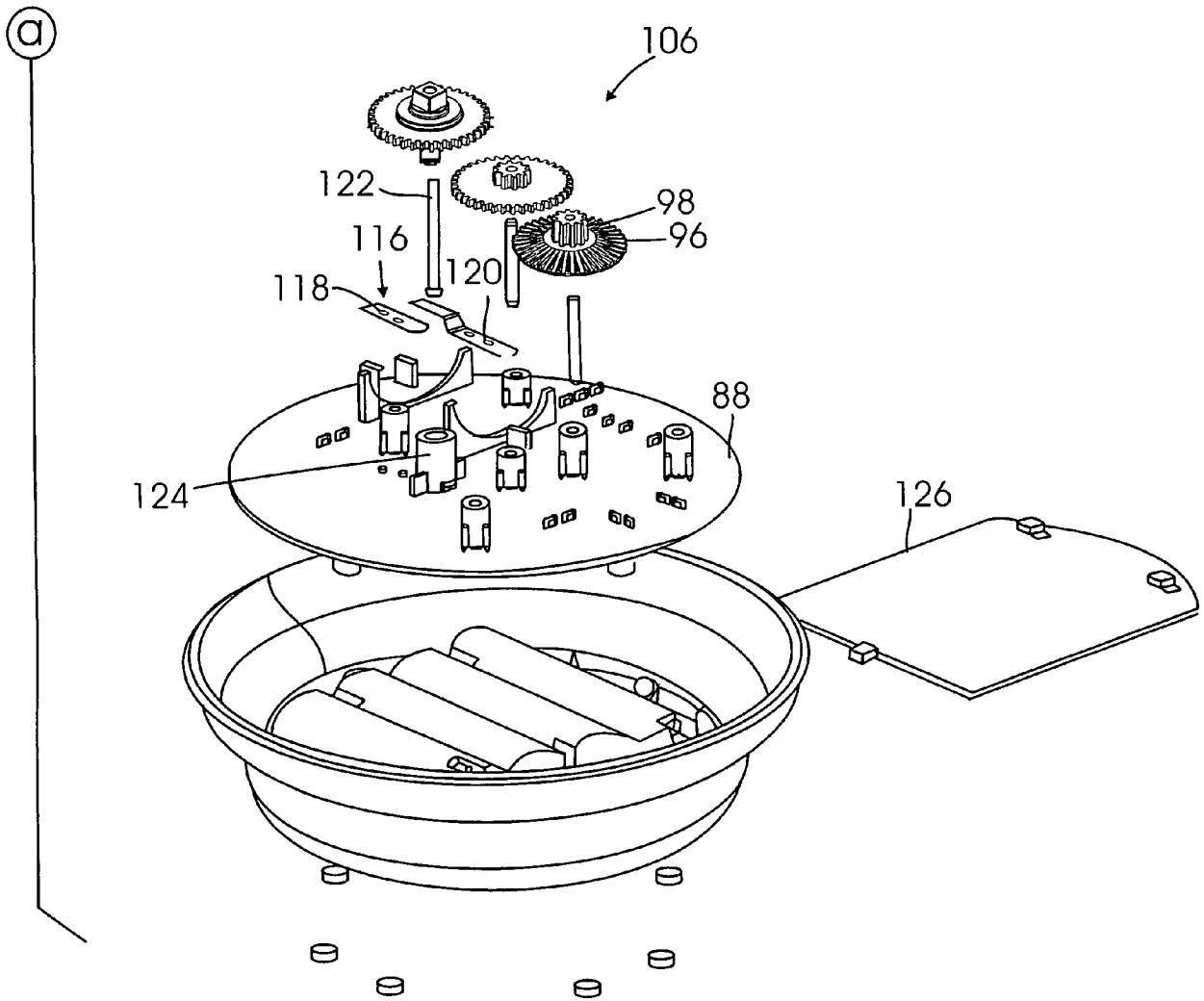
FIG. 6*b* is an exploded view of the bottom half of the present invention cosmetic pencil sharpener.

Referring to FIGS. 5 and 6*a* and 6*b*, a horizontal circular switch support platform 34 is supported by at least one post 37 so that the switch support platform is positioned between hemispherical top surface 12 and lower section wall 22. A cosmetic pencil receiving opening 36 extends through switch support platform 34. A notch 38 is formed at a circumferential location on the switch support platform which receives a detent (not shown) on the interior of top surface 12 so that the detent is locked into notch 38. The notch 38 and detent are aligned with the pair of openings 14 and 16. The top 12 rotates in the horizontal plane around switch support platform 34 so that either opening 14 or 16 is brought into alignment with cosmetic pencil receiving opening 36 and locked in that position by the mating detent and notch 38. A blocking cylinder 40 is formed on switch support platform 34 and is in alignment with cosmetic pencil receiving opening 36 so that the blocking cylinder 40 is aligned with the opening (14 or 16) not in alignment with the cosmetic pencil receiving opening 36 so that a person cannot put her finger or other object through the opening not in use and place it into the cosmetic pencil sharpener 10 while it is running. A start switch 42 rests on switch support platform 34 and is connected to an open switch connector spring 44 which is supported on switch support wall by a rectangular post 46. The start switch has a body 43 which extends into opening 36 (see FIG. 6*a*) and connector spring 44 is connected to body 43 (see FIG. 5). The open switch connector spring 44 in turn is connected to a transition connector spring 48 which is supported on switch support platform 34 by a rectangular post 50. When a cosmetic pencil 200 is inserted into opening 36, it pushes the portion of body 43 in opening 36 to move horizontally in the outward direction which in turn causes open switch connector spring 44 to come in contact with transition connector spring 48 to thereby close the circuit for start switch 42 to cause an electric motor to begin to operate. The transition connector spring 48 in turn is connected to a safety spring switch 52 which is supported on switch support platform 34 by a post 54. The post 54 partially extends through an opening 56 in the switch support platform 34 where the horizontal portion of the post 54 is in contact with a portion of the interior of the casing door 58 which is formed into upper casing wall 24. When the casing door 58 is opened, it causes post 54 to rise so that safety spring switch 52 also rises and breaks its connection with transition connector spring 48. As will be discussed later on, this causes the motor to stop so that the cutting blade will stop so that a person cannot be injured by a rotating cutting blade when the casing door is opened and a person can place his hand or finger into the interior of the cosmetic pencil sharpener. Also positioned on the switch support platform 34 is source of illumination 60 such as an LED. When the LED is illuminated, the illumination shines through window 20.

Figure 8:
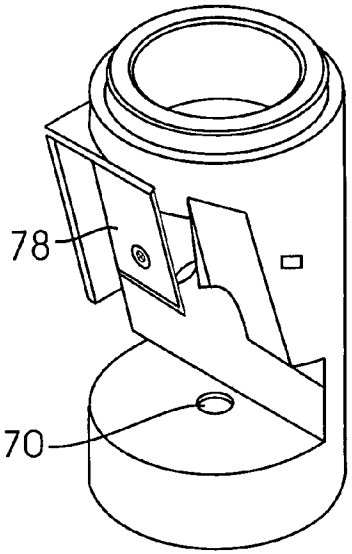
FIG. 8 is a perspective view of the sharpener body with the razor blade installed on the left wall.
Figure 8A:
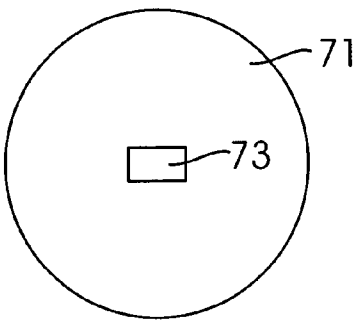
FIG. 8*a* is a bottom plan view of the bottom of the sharpener body.
Figure 7:
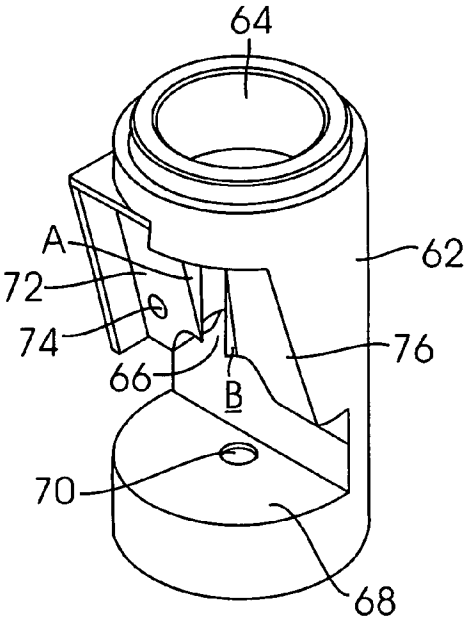
FIG. 7 is a perspective view of the sharpener body without the razor blade installed.

Positioned beneath the switch support platform 34 is the sharpener body 62. Referring to FIG. 7; the sharpener body 62 has a cylindrical top opening 64 which is aligned with opening 36 in switch support platform 34. Cylindrical top opening 64 extends into a central chamber 66 within sharpener body 62. The bottom of sharpener body 62 is a floor 68 which has a central opening 70 which is aligned with central chamber 66 and cylindrical opening 64. The sharpener body 62 is also comprised of a left wall 72 which has an interior surface formed at an angle "A" to the vertical, which preferred angle "A" is thirty degrees. The sharpener body also has an oppositely disposed right wall 76 which has an interior surface formed at an angle "B" to the vertical which preferred angle "B" is also thirty degrees. Left wall 72 also has a razor retaining opening 74. The interiors of left wall 72 and right wall 76 surround a portion of chamber 66. Referring to FIG. 8, left wall 72 supports a razor 78 which also extends at the angle "A" to the vertical. Referring to FIG. 8*a*, the bottom 71 of sharpener body 62 has a receiving opening 73 which receives a transfer engaging block 110.

Positioned within the interior of cosmetic pencil sharpener 10 and within upper casing wall 24 is an intermediate platform 80 which supports post 37 and in turn is supported by a multiplicity of posts such as 82. Intermediate platform 80 also has an opening 84 which is aligned with opening 70 in floor 68 of sharpener body 62. Sharpener body is positioned between switch support platform 34 and intermediate platform 80 so that it can rotate in the vertical plane between the two platforms. Intermediate platform 80 also has a motor cover 86. Supported from underneath intermediate platform 80 is electric motor 90 which has electric motor drive gear 92 extending from it.

Positioned within the interior of cosmetic pencil sharpener 10 and within lower casing wall 26 is a horizontally disposed gear assembly platform 88. Three gears are supported on the gear assembly platform 88. Positioned to be in contact with electric motor drive gear 92 is first gear assembly 94 having vertically extending gear teeth 96 on a horizontal base and horizontally extending gear teeth 98 on a vertical stem. The electric motor drive gear 92 is in contact with vertically extending gear teeth 96. An intermediate gear assembly 100 has horizontal teeth 102 on a horizontal platform and horizontal teeth 104 on a vertical stem. Sharpener gear assembly 106 has horizontal teeth 108 on a horizontal platform. Connected to the top of sharpener gear assembly 106 is a transfer engaging block 110 which has a sharpener indicator rod 112 extending vertically through it. The sharpener indicator rod 112 extends through opening 70 in the floor 68 of sharpener body 62. The sharpener indicator rod 112 also extends through the sharpener gear assembly 106 and is aligned with a plunger 122 which further extends into a support base 124 mounted on the top of the gear support platform 88. Supported within support base 124 is a light indicator switch 116 comprised of a lower portion and an upper portion. The light indicator switch 116 is normally open but if the sharpener indicator rod 112 is caused to move downwardly, it in turn moves the aligned plunger 122 downwardly so that the upper portion 120 comes in contact with the lower portion 118 and closes the switch. Light indicator switch 116 can be a leaf spring switch. The sharpener engaging block 110 is received in opening 73 so that as the sharpener gear assembly rotates, it causes the sharpener body 62 to rotate.

When assembled, sharpener gear assembly 106 is aligned with the sharpener body 62 such that transfer engaging block 110 and sharpener indicator rod 112 extend through opening 84 in intermediate platform 80 and transfer engaging block 110 is supported within base 68 of sharpener body 62 while sharpener indicator rod 112 extends through opening 70 in base 68 and extends to a location just below the bottom of razor 78 and the bottom of opposing wall 76 of sharpener body 62. In operation, when the electric motor 90 is activated, electric motor drive gear 92 turns clockwise and its teeth intermeshes with vertical teeth 96 of first gear assembly 94 causing it to turn counterclockwise. Horizontal teeth 98 of first gear assembly 94 intermeshes with horizontal teeth 102 and intermediate gear assembly 100 causing it to turn clockwise. Horizontal teeth 104 of intermediate gear assembly 100 intermeshes with horizontal teeth 108 of sharpener gear assembly 106 causing the sharpener gear assembly to turn counterclockwise. When this occurs, transfer engaging block 110 causes sharpener body 62 to rotate in the counterclockwise direction and in turn the razor 78 rotates in the counterclockwise direction.

Figure 4:
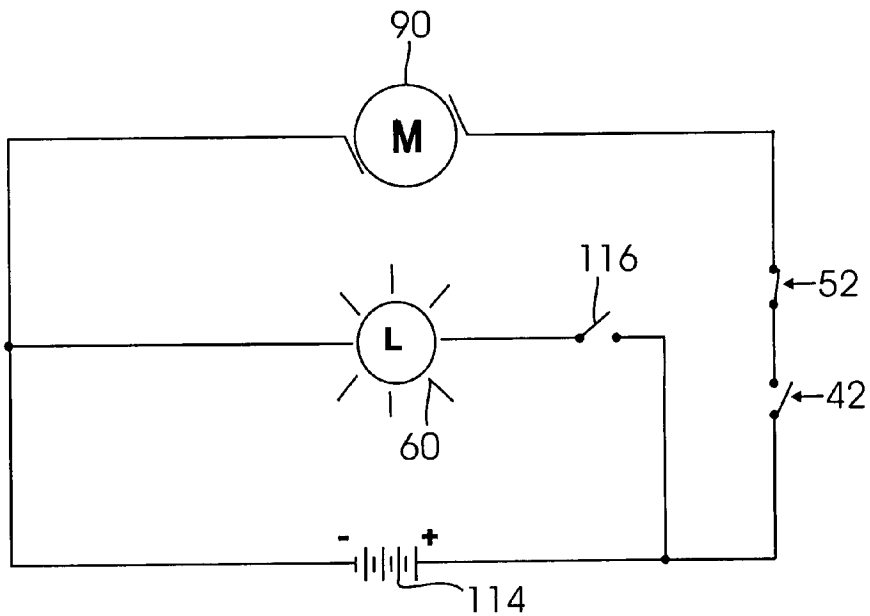
FIG. 4 is a circuit diagram of the electrical circuit of the present invention cosmetic pencil sharpener.

The unit is powered by at least one battery and preferably a multiplicity of batteries 114 which are electrically connected together to have one positive lead and one negative lead. The batteries rest in a battery compartment on the upper surface of base 30 at a location below gear intermediate platform 80. Access to the batteries 114 is achieved through sliding open a battery access door 126 located on the bottom on base 30. Referring to FIG. 4, the electrical circuitry of the cosmetic pencil sharpener is illustrated. The positive terminal from the battery 114 is connected to the start switch 42 which is normally open and which in turn is connected to the safety spring switch 52 which is normally closed. The safety spring switch 52 in turn is connected to the positive side of the electric motor 90. The negative terminal of the battery 114 is connected to the negative side of the electric motor 90. The negative terminal from the battery 114 is also connected to the negative side of the light source 60 and the positive terminal of the battery is connected to light indicator switch 116 which is normally open.

In operation, the casing door 58 is closed. The cosmetic pencil sharpener 10 is placed on a surface. The top surface 12 is rotated until one of the openings 14 or 16 is brought into alignment with opening 36 and snapped in place by the detent inside the inner surface of the top surface 12 coming into engagement with notch 38 on switch support platform 34. The cosmetic pencil 200 is then inserted into the selected opening (14 or 16) so that the wood portion 210 is above the top surface 12 and the paraffin wax portion 220 extends through openings 36 in switch support platform 34 and opening 64 in sharpener body 62 and into chamber 66. The wood portion 210 of the cosmetic pencil 200 pushes connector switch body 43 outwardly which causes open switch connector spring 44 to come into contact with transition connector spring 48 and this closes the circuit so that the electric motor 90 will start and thereby cause the gears to rotate as previously described so that sharpener gear assembly 106 rotates in the counterclockwise direction. Transfer engaging block 110 also rotates in the counterclockwise direction and causes sharpener body to rotate in the counterclockwise direction so that the razor 78 cuts the paraffin wax portion 220 of the cosmetic pencil 200. Because of the 30 degree angle of the edge of the razor blade 78 and the corresponding 30 degree angle of the opposing wall 76, the paraffin wax portion 220 is forced between the razor blade 78 and the opposing wall 76 and is cut at a net 30 degree angle, which is the ideal dimension for a cosmetic pencil. Because of the power of the batteries 114, the entire cutting process takes from one (1) to three (3) seconds. When the cutting is complete, the tip of the paraffin wax 220 comes in contact with the top of the sharpener indicator rod 112 as illustrated in FIG. 5 and pushes it down which in turn causes plunger 122 to be pushed down which in turn closes light indicator switch 116 which causes light source 60 to be illuminated which illumination shines through window 20 to advise to user that the sharpening process has been completed. The wax shavings fall on the intermediate platform 80. The starter switch 42 is opened when the sharpened cosmetic pencil is withdrawn because connector switch body 43 moves back into opening 36 so that open switch connector spring 44 moves away from transition connector spring 48 to open the circuit. The casing door is opened and the cosmetic pencil sharpener 10 turned upside down to empty the shavings into a waste receptacle. In the event the casing door 58 is opened while the motor 90 is running, the safety spring switch 52 is opened and immediately opens the circuit so that the motor 90 will stop running so that the razor 78 will not continue to rotate and possibly injure someone if they place their hand inside of the cosmetic pencil sharpener.

While the cutting angles "A" and "B" have been described as preferably being 30 degrees each. It is within the spirit and scope of the present invention for the angles "A" and "B" to each be in the ranges of 20 degrees to 40 degrees so that the range of the overall paraffin wax tip is between 20 degrees and 40 degrees.

The batteries are of sufficient strength to provide 10 volts of current. It is within the spirit and scope of the present invention for the batteries combined power to range from 5 volts to 30 volts. This can be in the form of at least one battery or a combination of batteries which are electrically linked together.

The razor blade 78 is preferably made of hardened tempered steel but can be made of any strong cutting material.

With respect to the size of the openings 14 and 16, the smaller opening 14 is ideally 0.30 inches and the larger opening 16 is ideally 0.45 inches.

The motor 90 and batteries 114 should be of sufficient power to cause the razor blade 78 and the sharpener body 62 to rotate between 45 rpm and 90 rpm to provide a strong clean cut and to cut the paraffin wax quickly and steadily so that the paraffin wax tip will not crack or shatter.

The present invention provides an very stabile and efficient apparatus for quickly and efficiently sharpening a cosmetic pencil to achieve an ideal point which will not shatter or crack and which will not be oversharpened because the warning light will immediately advise the user when the desired degree of sharpening has been achieved.

Defined in detail, the present invention is a cosmetic pencil sharpener, comprising: (a) a generally hemispherical top surface having a pair of differently sized oppositely disposed openings, the generally hemispherical top surface extending to a circumferential see-through window which in turn extends to a lower sectional wall which in turn extends to an upper casing wall which is connected to a lower casing wall by an interconnecting seam, the lower casing wall extending to a bottom wall which is supported by a multiplicity of feet which thereby provides a stable structure when placed on a horizontal surface; (b) a switch support platform supported adjacent the lower portion of the generally hemispherical top surface and supporting a switch assembly including a start switch connected to an open switch connector spring which is adjacent to a transition connector spring which in turn is connected to a safety spring switch, the switch support platform including means to permit the generally hemispherical top surface to rotate about the switch support platform and to be locked into a certain position, the switch support platform further supporting a source of illumination which shines through the circumferential see-through window when illuminated; (c) an intermediate platform positioned beneath the switch support platform and supporting an electric motor having a drive gear; (d) a gear assembly platform positioned beneath the intermediate platform and including a gear assembly which intermeshes with the drive gear of the electric motor and a sharpener gear assembly, the sharpener gear assembly including a transfer engaging block; (e) a sharpener body comprising a top opening, a central chamber, a floor and a bottom, the floor having an opening extending into the central chamber, the bottom having an opening which receives the transfer engaging block of the sharpener gear assembly, a left wall to one side of the central chamber and aligned at a given angle to the central chamber and supporting a razor also aligned at the given angle to the central chamber, and a right wall on the opposite side of the central chamber and aligned at the same given angle to the central chamber but the angle being oriented in the opposite direction, to thereby form a tight fit central chamber within the sharpener body; (f) the sharpener body rotatably positioned between the switch support platform and the intermediate platform and receiving the transfer engaging block of the sharpener gear assembly, the sharpener gear assembly further including a sharpener indicator rod extending vertically through the opening in the floor of the sharpener body and also through the transfer engaging block, and a plunger aligned with the sharpener indicator rod and extending downward from the sharpener gear assembly, the plunger positioned above a light indicator switch supported on the gear assembly platform; (g) the switch support platform having an opening which is aligned with the top opening in the sharpener body, the intermediate platform having an opening which is aligned with the opening in the floor of the sharpener body, and the engaging means of the sharpener gear assembly connected to the sharpener body and the sharpener indicating rod extending through the opening in the floor of the sharpener body to a location just below the razor and the oppositely disposed right wall; (h) a battery pack having at least one battery positioned on the bottom wall and electrically connected so that the positive terminal of the battery is connected to the start switch which in turn is connected to the positive side of the electric motor, the negative terminal of the battery connected to the negative side of the electric motor and also connected to the negative side of the source of illumination, the positive terminal of the battery connected to the light indicator switch; and (i) the generally hemispherical top surface rotated so that one of its openings is aligned with the opening in the switch support platform and a portion of the start switch extending into the opening in the switch support platform so that when a cosmetic pencil is inserted through an opening in the top surface, the cosmetic pencil causes the start switch to move so that the open connector spring comes in contact with the transition connector spring to thereby close the circuit for the battery and electric motor, the tip portion of the cosmetic pencil enters into the central chamber of the sharpener body where it is positioned between the razor and the right wall, the sharpener gear assembly is caused to rotate in the counterclockwise direction which in turn causes the sharpener body to rotate in the counterclockwise direction so that the razor sharpens the tip of the cosmetic pencil by rotating in the counterclockwise direction, the power of the battery being sufficient to enable the sharpening process to take place in from one to three seconds, and when the sharpening is completed the top of the cosmetic pencil presses against the sharpener indicator rod which in turn causes the source of illumination to shine through the window to advise that the sharpening process has been completed.

Defined broadly, the present invention is a cosmetic pencil sharpener for sharpening a cosmetic pencil with a fragile paraffin wax tip, comprising: (a) a body having an exterior surface and defining an interior chamber therein, the body formed of sufficient weight and strength to provide a stabile structure when placed on a horizontal surface, the exterior surface including a see-through portion which transmits light, and an access door; (b) the body including a top surface which is rotatably mounted on the body and having at least two different sized openings which can be rotatably brought into alignment with an opening inside the interior chamber; (c) a sharpener body rotatably supported within the chamber, the sharpener body including a central chamber, a left wall to one side of the chamber and aligned at a given angle to the central chamber and supporting a razor also aligned at a given angle to the central chamber, and a right wall on the opposite side of the central chamber and aligned at the same given angle to the central chamber but the angle being oriented in the opposite direction, to thereby form a paraffin wax tip positioning area within the sharpener body; (d) a source of electric power housed within the central chamber and connected to an electric motor which in turn is connected to a gear assembly which in turn is connected to means which rotatably support the sharpener body, the source of power also connected to a start switch means which is connected to an activation means which extends into the opening in the interior chamber and when closed by insertion of the cosmetic pencil sharpener into the opening inside the interior chamber activates the electric motor which in turn is connected to a source of illumination, the gear assembly including a sharpener indicator rod which comes in contact with an illumination switch which activates the source of illumination; (e) a safety switch connected to the access door so that the electric circuit is opened and the electric motor stopped when the access door is opened; and (f) the top surface being rotated so that one of its openings is brought into alignment with the opening in the interior chamber and the sharpener body and a cosmetic pencil is inserted through the opening which closes the activation means of the start switch after insertion, the paraffin wax tip of the cosmetic pencil is positioned between the razor and the oppositely disposed right wall, the source of power being of sufficient strength so that when the switch means is activated, the electric motor causes the gear assembly to rotate which in turn causes the sharpener body and its razor to rotate about the cosmetic pencil and sharpen its paraffin wax tip to the given angle within three seconds, and when sharpened the paraffin wax tip presses against the sharpener indicator rod which causes the switch to the source of illumination to be closed when the sharpening process is completed to thereby cause the source of illumination to illuminate the see-through portion to advise the user that sharpening is complete, the stability of the body and the speed of sharpening preventing the fragile wax tip from cracking or breaking during the sharpening process.

Defined more broadly, the present invention is a cosmetic pencil sharpener for sharpening a cosmetic pencil with a fragile paraffin wax tip, comprising: (a) a body having an exterior surface and defining an interior chamber therein, the body formed of sufficient weight and strength to provide a stabile structure when placed on a horizontal surface, the exterior surface including a see-through portion which transmits light, and an access door; (b) the body including a top surface which is rotatably mounted on the body and having at least two different sized openings which can be rotatably brought into alignment with an opening inside the interior chamber; (c) means rotatably supported within the chamber to receive the paraffin wax tip, the means including a razor mounted at a given angle, the means grasping the tip so that it is positioned against the razor so that the tip can be cut at the same angle as the razor; (d) an electric circuit which includes a source of electric power housed within the interior chamber and connected to an electric motor which in turn is connected to a gear assembly having an indicator rod, the gear assembly in turn is connected to the means which receives the paraffin wax tip, the source of power also connected to a start switch means which partially extends into the opening in the interior chamber, the start switch means activates the electric motor, the source of power also connected to a light indicator switch which in turn is connected to a source of illumination, the indicator rod of the gear assembly also connected to the light indicator switch which activates the source of illumination; (e) a safety switch means connected to an access door so that the electric circuit is opened and the electric motor stopped when the access door is opened; and (f) the top surface being rotated so that one of its openings is brought into alignment with the means to receive the paraffin wax tip and a cosmetic pencil is inserted through the opening so that the paraffin wax tip of the cosmetic pencil is positioned adjacent to a razor contained within the means to receive the paraffin wax tip, the source of power being of sufficient strength so that when the switch means is activated when the cosmetic pencil is inserted through the opening in the interior chamber, the electric motor causes the gear assembly to rotate which in turn causes the means to receive the paraffin wax tip and its razor to rotate about the tip of the cosmetic pencil and sharpen its paraffin wax tip to the given angle of the razor within three seconds, and the indicator rod of the gear assembly causing the switch to the source of illumination to be closed when the sharpening process is completed to thereby cause the source of illumination to illuminate the see-through portion to advise the user that sharpening is complete, the stability of the body and the speed of sharpening preventing the fragile wax tip from cracking or breaking during the sharpening process.

Defined even more broadly, the present invention is a cosmetic pencil sharpener for sharpening a cosmetic pencil with a fragile paraffin wax tip, comprising: (a) a body having an exterior surface and defining an interior chamber therein, the body formed of sufficient weight and strength to provide a stabile structure when placed on a horizontal surface, the exterior surface including a see-through portion which transmits light; (b) the body including a top surface which is rotatably mounted on the body and having at least two different sized openings which can be rotatably brought into alignment with an opening inside the interior chamber; (c) means rotatably supported within the chamber to receive the paraffin wax tip, the means including a razor mounted at a given angle, the means grasping the tip so that it is positioned against the razor so that the tip can be cut at the same angle as the razor;

(d) an electric circuit which includes a source of electric power housed within the interior chamber and connected to an electric motor which in turn is connected to an assembly which is connected to an indicator rod, the assembly in turn is connected to the means which receives the paraffin wax tip, the source of power also connected to a start switch means which partially extends into the opening in the interior chamber, the start switch means which activates the electric motor from the source of power also connected to a light indicator switch which in turn is connected to a source of illumination, the assembly also connected to a switch which activates the source of illumination; and (e) the top surface being rotated so that one of its openings is brought into alignment with the means to receive the paraffin wax tip and a cosmetic pencil is inserted through the opening so that the paraffin wax tip of the cosmetic pencil is positioned adjacent the razor contained within the means to receive the paraffin wax tip, the source of power being of sufficient strength so that when the switch means is activated when the cosmetic pencil is inserted through the opening in the interior chamber, the electric motor causes the assembly to rotate which in turn causes the means to receive the paraffin wax tip and its razor to rotate about the tip of the cosmetic pencil and sharpen its paraffin wax tip to the given angle of the razor within three seconds, and the indicator rod causing the switch to the source of illumination to be closed when the sharpening process is completed to thereby cause the source of illumination to illuminate the see-through portion to advise the user that sharpening is complete, the stability of the body and the speed of sharpening preventing the fragile wax tip from cracking or breaking during the sharpening process.

Defined even more broadly, the present invention is a cosmetic pencil sharpener for sharpening a cosmetic pencil with a fragile paraffin wax tip, comprising: (a) a body having an exterior surface and defining an interior chamber therein, the body formed of sufficient weight and strength to provide a stabile structure when placed on a horizontal surface; (b) the body including a surface which is rotatably mounted on the body and having at least two different sized openings which can be rotatably brought into alignment with an opening inside the interior chamber; (c) means rotatably supported within the chamber to receive the paraffin wax tip, the means including a razor mounted at a given angle, the means grasping the tip so that it is positioned against the razor so that the tip can be cut at the same angle as the razor; (d) a source of electric power housed within the interior chamber and connected to an electric motor which in turn is connected to an assembly which in turn is connected to the means which receives the paraffin wax tip, the source of power also connected to switch means which is in communication with the opening in the interior chamber, the switch means activates the electric motor; and (e) the surface being rotated so that one of its openings is brought into alignment with the means to receive the paraffin wax tip and a cosmetic pencil is inserted through the opening so that the paraffin wax tip of the cosmetic pencil is positioned adjacent the razor, the source of power being of sufficient strength so that when the switch means is activated by insertion of the cosmetic pencil into the opening inside the interior chamber, the electric motor causes the assembly to rotate which in turn causes the means to receive the paraffin wax tip and its razor to rotate about the tip of the cosmetic pencil and sharpen its paraffin wax tip to the given angle of the razor within three seconds, the stability of the body and the speed of sharpening preventing the fragile wax tip from cracking or breaking during the sharpening process.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A cosmetic pencil sharpener, comprising:

a. a generally hemispherical top surface having a pair of differently sized oppositely disposed openings, the generally hemispherical top surface extending to a circumferential see-through window which in turn extends to a lower sectional wall which in turn extends to an upper casing wall which is connected to a lower casing wall by an interconnecting seam, the lower casing wall extending to a bottom wall which is supported by a multiplicity of feet which thereby provides a stable structure when placed on a horizontal surface;

b. a switch support platform supported adjacent the lower portion of the generally hemispherical top surface and supporting a switch assembly including a start switch connected to an open switch connector spring which is adjacent to a transition connector spring which in turn is connected to a safety spring switch, the switch support platform including means to permit the generally hemispherical top surface to rotate about the switch support platform and to be locked into a certain position, the switch support platform further supporting a source of illumination which shines through said circumferential see-through window when illuminated;

c. an intermediate platform positioned beneath said switch support platform and supporting an electric motor having a drive gear;

d. a gear assembly platform positioned beneath said intermediate platform and including a gear assembly which intermeshes with the drive gear of said electric motor and a sharpener gear assembly, the sharpener gear assembly including a transfer engaging block;

e. a sharpener body comprising a top opening, a central chamber, a floor and a bottom, the floor having an opening extending into the central chamber, the bottom having an opening which receives the transfer engaging block of the sharpener gear assembly, a left wall to one side of the central chamber and aligned at a given angle to the central chamber and supporting a razor also aligned at the given angle to the central chamber, and a right wall on the opposite side of the central chamber and aligned at the same given angle to the central chamber but the angle being oriented in the opposite direction, to thereby form a tight fit central chamber within the sharpener body;

f. the sharpener body rotatably positioned between the switch support platform and the intermediate platform and receiving the transfer engaging block of the sharpener gear assembly, the sharpener gear assembly further including a sharpener indicator rod extending vertically through the opening in the floor of the sharpener body and also through the transfer engaging block, and a plunger aligned with the sharpener indicator rod and extending downward from the sharpener gear assembly, the plunger positioned above a light indicator switch supported on said gear assembly platform;

g. the switch support platform having an opening which is aligned with the top opening in the sharpener body, the intermediate platform having an opening which is aligned with the opening in the floor of the sharpener body, and the engaging means of the sharpener gear assembly connected to said sharpener body and the sharpener indicating rod extending through the opening in the floor of the sharpener body to a location just below the razor and the oppositely disposed right wall;

h. a battery pack having at least one battery positioned on the bottom wall and electrically connected so that the positive terminal of the battery is connected to the start switch which in turn is connected to the positive side of the electric motor, the negative terminal of the battery connected to the negative side of the electric motor and also connected to the negative side of the source of illumination, the positive terminal of the battery connected to the light indicator switch; and i. the generally hemispherical top surface rotated so that one of its openings is aligned with the opening in the switch support platform and a portion of the start switch extending into the opening in the switch support platform so that when a cosmetic pencil is inserted through an opening in the top surface, the cosmetic pencil causes the start switch to move so that the open connector spring comes in contact with the transition connector spring to thereby close the circuit for the battery and electric motor, the tip portion of the cosmetic pencil enters into the central chamber of the sharpener body where it is positioned between the razor and the right wall, the sharpener gear assembly is caused to rotate in the counterclockwise direction which in turn causes the sharpener body to rotate in the counterclockwise direction so that the razor sharpens the tip of the cosmetic pencil by rotating in the counterclockwise direction, the power of the battery being sufficient to enable the sharpening process to take place in from one to three seconds, and when the sharpening is completed the top of the cosmetic pencil presses against the sharpener indicator rod which in turn causes the source of illumination to shine through the window to advise that the sharpening process has been completed.

2. The cosmetic pencil sharpener in accordance with claim 1, further comprising an access door in said upper casing wall, the access door connected to said safety spring switch so that the safety spring switch causes the electric motor to stop running when the access door is opened.

3. The cosmetic pencil sharpener in accordance with claim 1 wherein the razor and the right wall are each aligned at 30 degrees to the vertical so that the tip of the cosmetic pencil is sharpened to 30 degrees.

* * * * *